United States Patent [19]

Gaylord

[11] 4,086,899

[45] May 2, 1978

[54] AIR FUEL INLET DEVICE FOR INTERNAL COMBUSTION ENGINES

[76] Inventor: James K. Gaylord, 419 Sheridan Rd., Winnetka, Ill. 60093

[21] Appl. No.: 712,654

[22] Filed: Aug. 9, 1976

[51] Int. Cl.[2] ..... F02M 29/00

[52] U.S. Cl. ..... 123/141; 261/78 R; 48/180 R

[58] Field of Search ..... 123/141; 261/78 R; 48/180 R, 180 C, 180 M, 180 P, 180 S, 180 H, 180 B, 180 F, 180 A

[56] References Cited

U.S. PATENT DOCUMENTS

| | | | |
|---|---|---|---|
| 921,934 | 5/1909 | Willard | 48/180 M |
| 1,093,385 | 4/1914 | Clemmer | 48/180 R |
| 1,121,868 | 12/1914 | Riotte et al. | 123/141 |
| 1,472,665 | 10/1923 | Mowen | 48/180 R |
| 1,483,314 | 2/1924 | Rosenbrook | 48/180 M |
| 1,522,205 | 1/1925 | Petrovsky | 48/180 M |
| 1,652,010 | 12/1927 | Halloway | 48/180 B |
| 2,639,230 | 5/1953 | Lefebre | 123/141 X |
| 3,645,243 | 2/1972 | Ohlsson | 48/180 R X |

FOREIGN PATENT DOCUMENTS

| | | | |
|---|---|---|---|
| 1,019,861 | 1957 | Germany | 123/141 |

*Primary Examiner*—Charles J. Myhre
*Assistant Examiner*—Ira S. Lazarus
*Attorney, Agent, or Firm*—Gary, Juettner & Pyle

[57] ABSTRACT

An air-fuel inlet device for an internal combustion engine characterized by a spacer having passages therethrough with spaced parallel annular recesses formed in the side walls of the passages.

The spacer is positionable between a carburetor and an intake manifold of an engine with the passages establishing communication between the outlets from the carburetor and the inlets to the manifold. It has been found that when the spacer is substantially one inch thick, and the annular recesses are essentially square in cross section and have a width and depth of substantially 1/16 inch and a spacing of 1/16 inch along the passages, engine efficiency is significantly increased, fuel consumption is decreased, and exhaust emissions are significantly decreased.

15 Claims, 3 Drawing Figures

AIR FUEL INLET DEVICE FOR INTERNAL COMBUSTION ENGINES

BACKGROUND OF THE INVENTION

The invention relates to a device for use in the air-fuel inlet system of an internal combustion engine to increase the efficiency thereof and to decrease emissions exhausted therefrom.

Various devices for use in the air-fuel inlet systems of internal combustion engines, particularly automotive engines, have heretofore been developed. Such devices are alleged to increase fuel economy and, in some cases, to decrease exhaust emissions.

Included among such devices, by way of example, are those positionable between the carburetor and the intake manifold of the engine to intercept the air-fuel mixture. The devices are generally said to operate on the mixture, such as by imparting an electrostatic charge thereto or by "chopping" the mixture to more finely divide the fuel particles and to disperse a uniform fuel mixture uniformly to all the cylinders to the engine. This should result in, and the prior art devices were supposedly intended to produce the result of, increased engine performance and miles per gallon, and decreased emissions.

Because of growing public concern for a clean environment and decreased fuel consumption, large numbers of such devices have been purchased and installed on automobile engines. Many of the devices are cumbersome and difficult to install, or when used in accordance with instructions require changes in engine timing. Unfortunately, in their use they have been found to yield little if any improvement in fuel economy or decrease in emissions. To the contrary, use of some of the devices actually results in increased fuel usage and poor engine performance. Furthermore, with those devices requiring a change in engine timing, generally an over-advanced timing, engine damaging spark knock frequently occurs, which often cannot be eliminated even with use of a more expensive, higher octane rated gasoline.

Because of the inability of these prior art devices to fullfill the purposes for which they were promoted, the general concept of in-line carburetor attachments has fallen into a degree of disrepute, although some devices such as high rise headers are still actively promoted. For the most part, however, the art has looked for different solutions.

THE INVENTION

The present invention is based on the almost accidental discovery that an in-line spacer of specific thickness and specific internal passage construction will in fact improve engine performance, decrease fuel consumption, and decrease exhaust emissions.

The primary object of the present invention is to provide a device for use in the air-fuel system of an internal combustion engine which will actually increase the efficiency and power output of the engine while simultaneously decreasing fuel consumption.

Another object of the invention is to provide a device which reduces emissions exhausted from the engine.

Yet another object is to provide a device of simple and economical construction which may be simply and inexpensively installed on the engine.

SUMMARY OF THE INVENTION

In accordance with the present invention, a device for use between a carburetor and an intake manifold of an internal combustion engine is characterized by a spacer positionable between the base of the carburetor and the inlet of the manifold and having, as necessary, one or more passages therethrough for aligned communication between the carburetor outlet and the manifold inlet, the wall surface of each passage being formed with a plurality of spaced parallel annular recesses.

In the preferred embodiment, the spacer as installed on the engine is substantially one inch thick, and each passage therethrough has an inner diameter substantially equal to that diameter of the corresponding carburetor outlet. The recesses formed in the wall surface of the passage are spaced parallel grooves disposed perpendicular to the axis of the passage. The grooves are essentially square in cross section with a width and depth of substantially 1/16 inch, and a spacing along the length of the passage of substantially 1/16 inch. The number and the size of the passages in the spacer is determined by the number and the size of the outlets or barrels in the carburetor.

While the exact theory of operation of the spacer of the invention is not known and can only be theorized as discussed in the following detailed description, it has been discovered that use of the spacer significantly increases engine efficiency, decreases fuel consumption, and decreases exhaust emissions.

Other objects, advantages and features of the invention will become apparent from the following detailed description as considered in conjunction with the accompanying drawings.

DETAILED DESCRIPTION

Figure 1:
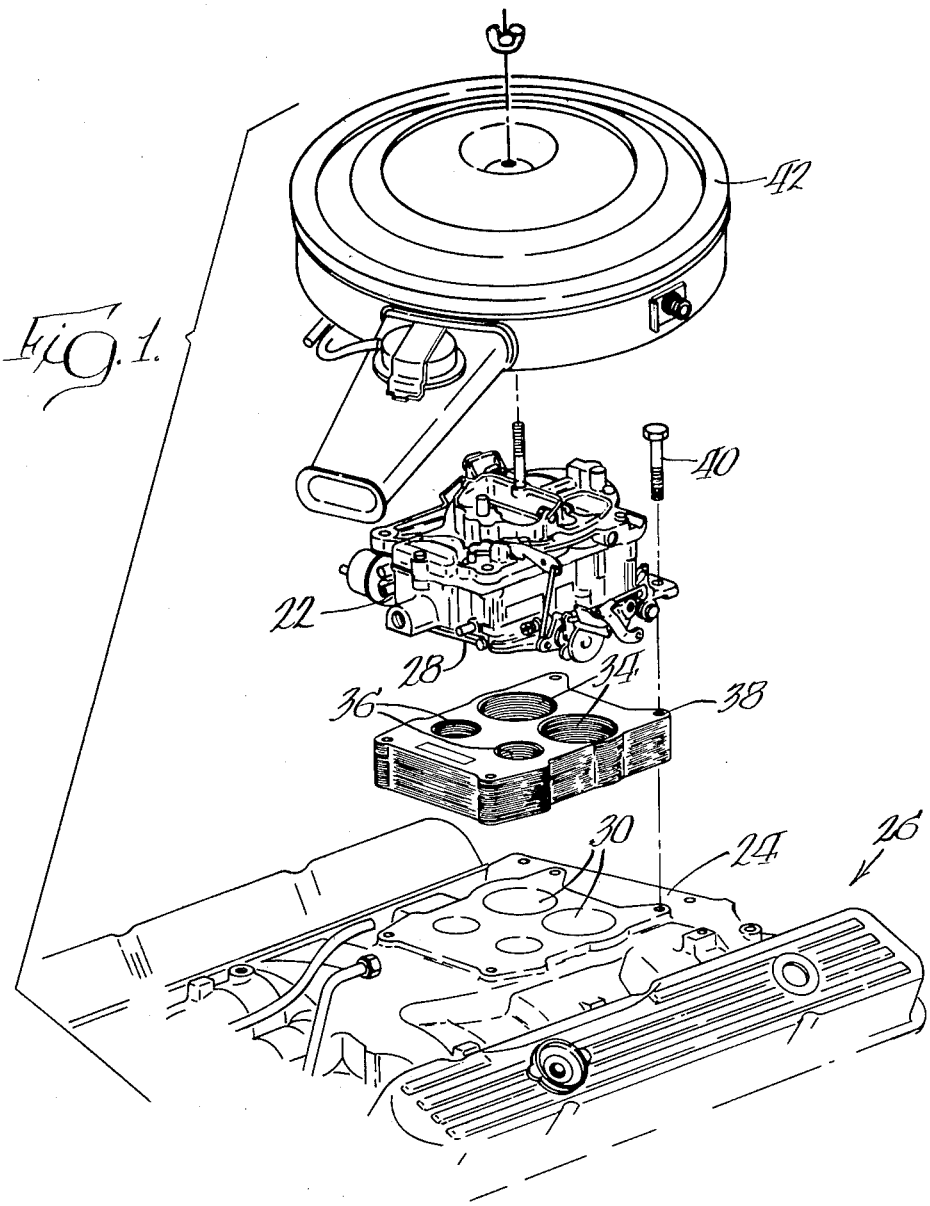
FIG. 1 is an exploded perspective view showing the manner in which a spacer embodying the teachings of the present invention is positioned between the carburetor and the intake manifold of an internal combustion engine having a four barrel carburetor.
Figure 2:
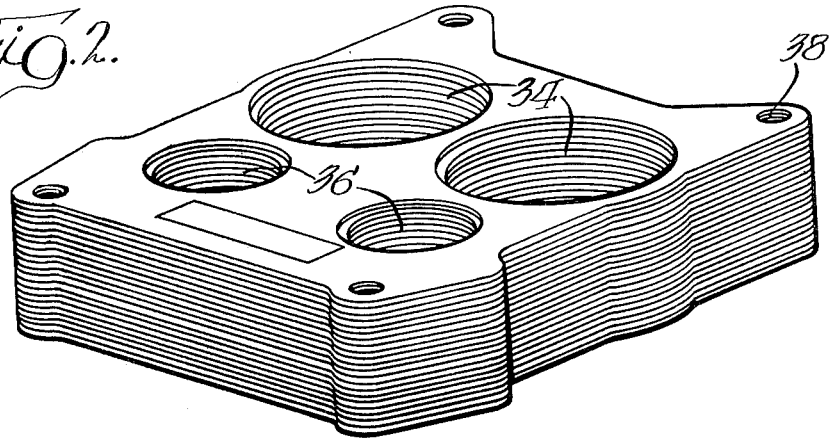
FIG. 2 is an enlarged perspective view of the spacer shown in FIG. 1.

Referring to FIGS. 1 and 2 of the drawings, a spacer 20, structured in accordance with the teachings of the present invention, is adopted to be positioned between a carburetor 22 and an intake manifold 24 of an internal combustion engine 26. The spacer illustrated is for use with a four-barrel (two primary and two secondary barrels) carburetor, and as such has four passages formed therethrough. It is to be understood, however, that the teachings of the invention also apply to spacers for use with carburetors having any other number of barrels, such spacers having one passage therethrough for single-barrel carburetors, two passages therethrough for two-barrel carburetors, etc; and that the teachings of the invention are generally applicable to air-fuel mixture supply systems.

The carburetor barrels extend from inlets at the upper end of the carburetor to outlets in a base 28 of the carburetor, and in the absence of the spacer, the secondary barrel outlets communicate directly with a pair of relatively enlarged inlets 30 in the manifold, and the primary barrel outlets communicate directly with a pair of somewhat smaller manifold inlets 32, to provide an air-fuel mixture to the manifold. The configuration of the spacer conforms generally with the base of the carburetor and the inlet area or surface of the manifold. When positioned between the base of the carburetor and the inlet surface of the manifold, the spacer 20 defines a pair of relatively enlarged passages 34 which align axially with the carburetor secondary outlets and the corresponding manifold inlets 30, and a pair of relatively smaller passages 36 which align axially with the carburetor primary outlets and the manifold inlets 32. The passages 34 and 36 are of generally like diameter with their associated carburetor outlets.

A plurality of holes 38 are formed through the spacer in positions to accommodate the carburetor to manifold mounting bolts 40, or to receive upstanding carburetor mounting studs (not shown), whereby the spacer is properly aligned with the carburetor and the manifold, and the carburetor may readily be mounted to the manifold with the spacer compressed therebetween. As is customary, an air filter 42 filters the air drawn into the carburetor.

It has been discovered that when the spacer 20 is configured and dimensioned in accordance with the teachings of the invention, significant increases in engine efficiency and performance are obtained, with corresponding reductions in exhaust emissions. More particularly, and referring to FIGS. 2 and 3, when the spacer is of a thickness (when compressed) to support the base of the carburetor substantially one inch above the manifold inlets, and when the surfaces of the passages through the spacer are formed with a plurality of spaced, annular recesses 44, the aforementioned improved engine efficiency results. Particular advantages are obtained when the recesses are of square cross section, lie in planes perpendicular to the axes of the passages, have a nominal width and depth of 1/16 inch, and are spaced apart 1/16 inch along the length of the passages. The recesses then define therebetween and along the passages a plurality of spaced, annular surface segments 46 having a nominal width and height of 1/16 inch and square corners.

Figure 3:
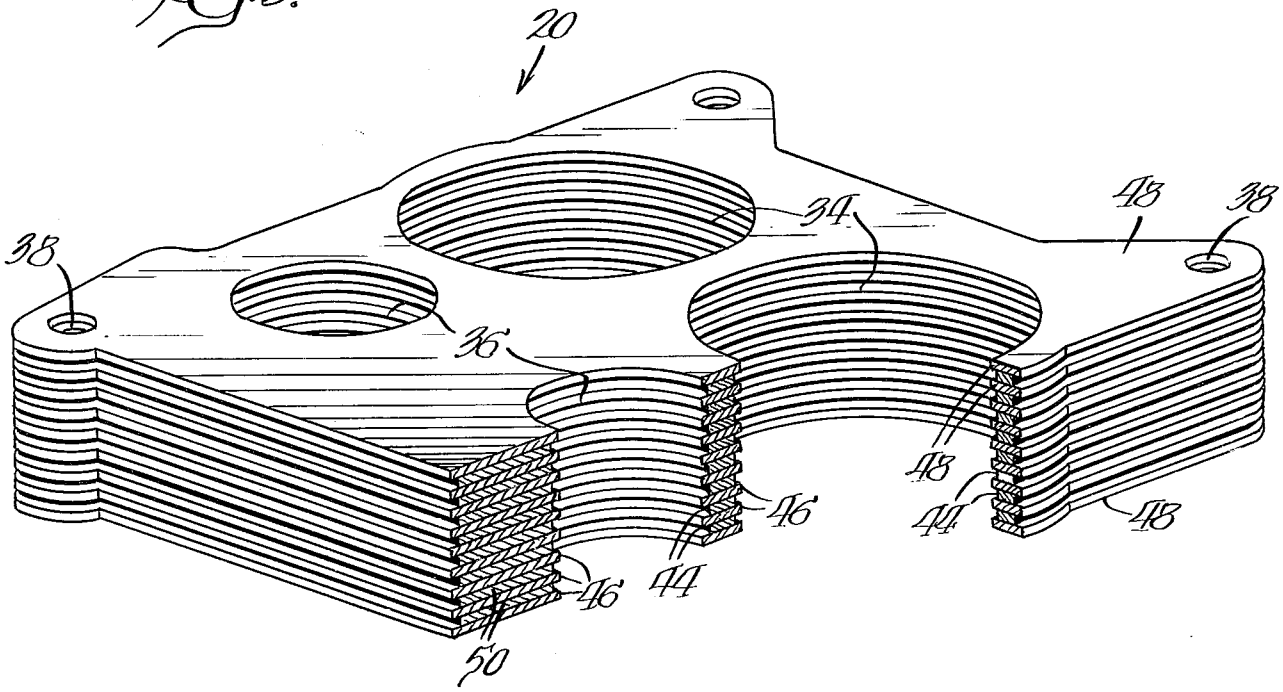
FIG. 3 is a fragmentary perspective view of the spacer, illustrating one construction thereof and the surface configuration of passages therethrough.

The spacer 20 may be of monolithic structure with the recesses 44 machined into the passage walls, or it may be of quasi-monolithic structure comprised of a plurality of joined sections, or it may be comprised of an assembled stack of individual plates. In a contemplated economical mode of manufacture, the spacer is formed of a stack of individual interleaved plates each nominally 1/16 inch thick. Referring to FIG. 3, with this construction the spacer includes a first set of 1/16 inch thick plates 48, each having passages formed therethrough equal in number to the outlets from the carburetor and axially alignable and of equal diameter therewith. The spacer also includes a second set of 1/16 inch thick plates 50, each having passages formed therethrough equal in number to the outlets from the carburetor and axially alignable therewith, and of a diameter substantially ⅛ inch greater than the diameter of their associated outlets.

The plates of the first and second sets are interleaved in alternate fashion to form a stack, which when compressed in use will be substantially 1 inch thick, with the passages axially aligned. To facilitate handling of the stack, the plates 48 and 50 may be aligned by use of the bolt holes 38 and may then be bounded together with a suitable adhesive or cement. In the preferred construction, the plates 48 are of a gasket material, such as cork, asbestos or the like, and the plates 50 are of a metal such as aluminum.

It should be noted that the spacer is required to support the base of the carburetor substantially one inch over the intake manifold and that the spacer must be sealed to both the carburetor and the manifold. Thus, when each plate has a nominal thickness of 1/16 inch, and the plates of one set are formed of compressible gasket material, it will be necessary to employ more than sixteen plates. In the spacer shown, for example, the gasket material plates 48 are compressible, while the metal planes 50 are not, and to obtain a thickness of substantially one inch when the spacer is compressed between and sealed to the carburetor and the manifold, it is necessary to use nine gasket material plates and eight metal plates with gasket material plates exposed to the opposite ends of the stack. Thus, the stack as manufactured has a total uncompressed thickness of 1 1/6 inch. Should the plates of both sets be of compressible material, or should the spacer be made in another manner from compressible material, then the dimensions would be selected, dependent upon the degree of compression to which subjected in use, to provide the above described structure in the compressed state. On the other hand, if the plates of both sets were incompressible, or should the spacer be made an incompressible monolithic structure, then the dimensions of the spacer as manufactured would be of the above-described final dimensions taking into consideration the gasketing required at both ends thereof.

It is not precisely known how the spacer of the invention increases engine efficiency and performance while decreasing emissions. However, experimentation has shown that it does, and that its advantages decrease when its dimensions are significantly varied from the unique nominal values. Although it cannot be stated with certainty, it is believed that the benefits derived are attributable to the recesses 44 providing spaces for the formation of trapped vortices of fluid upon flow of an air-fuel mixture through the passages in response to manifold vacuum. It is theorized that torroidal trapped vortices of fluid are formed in the recesses 44 which, in a sense, act as very low friction "ball bearings" relative to the flow of the air-fuel mixture through the passages. Also, these trapped vortices could cause a quiescent stagnant boundary layer of the mixture to build-up adjacent the passage walls and to extend smoothly inward of the centers of the passages to slightly restrict the flow areas therethrough. The boundary layers would then provide smooth surfaces for laminar flow of the mixture through the passages, and the restricted flow areas would cause an acceleration of the mixture. This in turn would result in an increased velocity and greater volume of the mixture entering the intake manifold, with consequent improved dispersion of the mixture to all cylinders of the engine. Further, it is possible that the additional flow length of the mixture through the spacer passages, as well as the increased velocity of flow therethrough, results in a more homogeneous air-fuel mixture entering the manifold. As a consequence, all of the cylinders of the engine would be supplied substantially uniformly with a substantially uniform, homogeneous mixture of fuel and air which would not only result in balanced combustion between the cylinders, but also in more efficient combustion therewithin. This, then could account for the measurably improved engine efficiency and performance, decreased fuel consumption, and decreased exhaust emissions obtained by use of the spacer, as ascertained by the following comparative tests.

COMPARATIVE TESTS

To best illustrate the specific advantages of increased economy and performance and decreased emissions obtained with use of the spacer of the invention, comparative tests were conducted with automobiles equipped with and without the spacer, as well as with a spacer having modified dimensions. The automobiles had automatic transmissions and cruise controls. For tests relating to economy and emissions, the cruise controls were used to maintain vehicle speed as constant as possible. For tests relating to performance (acceleration), several runs were made to predetermined speeds and the elapsed times averaged.

The following tests 1–6 were conducted with a 1975 Chevrolet Monte Carlo having 350 cubic inch displacement engine, a two-barrel carburetor, and a single exhaust:

ECONOMY AND EMISSIONS

| | Test number (see notes) | | | |
|---|---|---|---|---|
| | 1 | 2 | 3 | 4 |
| Total milage | 216.2 | 216.2 | 216.8 | 98.8 |
| Average speed | 51.3 | 50.7 | 51.0 | 49.3 |
| Miles per gallon | 17.7 | 18.6 | 15.9 | 17.0 |
| Carbon monoxide at 55 m.p.h. (%) | 2.0 | 1.0 | 1.34 | .93 |
| Carbon monoxide at idle (%) | .87 | .25 | .75 | .37 |

Notes on the tests:

Test no. 1 Conducted without a spacer.
Test no. 2 Conducted with a spacer constructed in accordance with the teachings of the invention and having the preferred dimensions.
Test no. 3 Conducted with a spacer one inch thick but without recesses in the passages thereof.
Test. no. 4 Conducted with a spacer one inch thick and having recesses in the passages thereof 5/64 inch deep.

PERFORMANCE

| | Test number (see notes) | |
|---|---|---|
| | 5 | 6 |
| Acceleration 0–60 m.p.h. | 12.44 sec. | 12.1 sec. |
| Acceleration 20–50 m.p.h. | 7.16 sec. | 6.1 sec. |

Notes on the tests:

Test no. 5 Conducted without a spacer
Test No. 6 Conducted with a spacer constructed in accordance with the teachings of the invention and having the preferred and dimensions.

The following tests 7–12 were conducted with a 1976 Cadillac Fleetwood having a 500 cubic inch displacement engine, a four-barrel carburetor, and a single exhaust.

ECONOMY AND EMISSIONS

| | Test number (see notes) | | | |
|---|---|---|---|---|
| | 7 | 8 | 9 | 10 |
| Total milage | 51.5 | 51.4 | 50.6 | 50.5 |
| Average speed | 47.5 | 49 | 47.43 | 49.7 |
| Miles per gallon | 15.35 | 15.35 | 14.25 | 14.22 |
| Carbon monoxide at 55 m.p.h. (%) | 0 | 0 | 0 | 0 |
| Carbon monoxide at idle (%) | 0 | 4 | 0 | 2.5 |

Notes on the test:

Test nos. 7 and 8 Conducted with a spacer constructed in accordance with the teachings of the invention and having the preferred dimensions.
Test nos. 9 and 10 Conducted without a spacer.

-continued

PERFORMANCE

| | Tests number (see notes) | |
|---|---|---|
| | 11 | 12 |
| Acceleration 0–60 m.p.h. | 11.33 | 10.7 |
| Acceleration 20–50 m.p.h. | 6.23 | 6.1 |

Notes on the test:

Test no. 11 Conducted without a spacer
Test no. 12 Conducted with a spacer constructed in accordance with the teachings of the invention and having the preferred dimensions.

As seen from the data, both the two and four-barrel carburetor equipped automobiles exhibited increased economy (miles per gallon) and performance (acceleration) when operated with a spacer configured and dimensioned in accordance with the teachings of the invention, as compared with the same automobiles when operated without the spacer. In tests 1–6 using a far less sophisticated and far less expensive automobile, and one which is in far more popular use, the spacer also drastically reduced exhaust emissions. Test 4 illustrates the decrease in results obtained upon even slight departure from the dimensions thus far found to be preferred.

While the illustrated and preferred embodiment of the invention has been described as a spacer for insertion between the carburetor and intake manifold of an internal combustion engine, the invention contemplates, and is intended to include, by way of example, integral formation of the spacer as an extension of either the manifold inlet or the base of the carburetor to define one or more air-fuel passages structured and dimensioned in accordance with the teachings of the invention. Also, while only one particular embodiment of the invention has been described in detail, various other modifications and embodiments thereof may be devised by one skilled in the art without departing from the spirit and the scope of the invention, as defined by the appended claims.

What is claimed is:

1. In a device for use in a fuel supply system, a spacer insertable in the supply system and having a passage therethrough for transmission of the fuel, the surface of said passage having a plurality of recesses of square cross section therein.

2. In a device for use in a fuel supply system, a spacer insertable in the supply system and having a passage therethrough for transmission of the fuel, the surface of said passage having a plurality of recesses therein, said spacer being of a thickness to maintain a passage length of substantially one inch in said supply system.

3. In a device as set forth in claim 2, said passage being cylindrical and said recesses comprising annular spaced parallel recesses lying in planes essentially perpendicular to the axis of said passage.

4. In a device as set forth in claim 3, said recesses being of square cross section.

5. In a device as set forth in claim 3, said recesses having a width and depth of substantially 1/16 inch and a spacing along the length of said passage of substantially 1/16 inch.

6. In a device for use in a fuel supply system, a spacer insertable in the supply system and having a passage therethrough for transmission of the fuel, the surface of said passage having a plurality of recesses therein, said spacer including a first set of plates each nominally 1/16 inch thick and formed with a passage therethrough of a diameter substantially equal to the diameter of said supply system, and a second set of plates each nominally 1/16 inch thick and formed with a passage therethrough of a diameter substantially ⅛ inch greater than the diameter of said supply system, said first and second sets of plates being interleaved to alternate said plates of said first and second sets and to coaxially align said passages to form a stack of plates of a thickness to maintain a passage length of substantially one inch in said supply system.

7. In a device as set forth in claim 6, said plates of said first set being formed of a gasket material and said plates of said second set of metal.

8. In a device as set forth in claim 7, said plates of said second set being eight in number and said plates of said first set being nine in number and including the two outermost plates for effecting sealed engagement with said supply system at the opposite ends of said spacer.

9. A device for use between a carburetor and an intake manifold of an internal combustion engine to increase the efficiency and performance of the engine, the carburetor being of a type having a base and at least one outlet therein for communication with at least one associated inlet in the manifold for providing an air-fuel mixture therein, said device comprising a spacer for being positioned between the carburetor base and the manifold and having a thickness for maintaining a spacing of substantially one inch between the base and manifold, said spacer being formed with the same number and size of passages therethrough as the outlets from the carburetor and the inlets to the manifold and respectively alignable therewith, each passage being associable with an individual one of the outlets and inlets upon said spacer being positioned between the base and the manifold and having an inner diameter substantially equal to the diameter of the respective outlet and inlet for aligned communication therebetween, each passage having a plurality of recesses formed circumferentially therein along its length.

10. In a device as set forth in claim 9, said recesses in each of said passages comprising spaced parallel annular recesses lying in planes perpendicular to the axis of said passage, being of substantially square cross section, having a width and depth substantially 1/16 inch, and being spaced substantially 1/16 inch apart along the length of said passage.

11. In a device for use between a carburetor and an intake manifold of an internal combustion engine to increase the efficiency and performance of the engine, the carburetor being of a type having a base and at least one outlet therein for communication with at least one associated inlet in the manifold for providing an air-fuel mixture therein, said device comprising a spacer for being positioned between the carburetor base and the manifold and having a thickness for maintaining a spacing of substantially one inch between the base and manifold, said spacer being formed with the same number and size of passages therethrough as the outlets from the carburetor and the inlets to the manifold and respectively alignable therewith, each passage being associable with an individual one of the outlets and inlets upon said spacer being positioned between the base and the manifold and having an inner diameter substantially equal to the diameter of the respective outlet and inlet for aligned communication therebetween, said spacer including a first set of nine plates of a relatively compressible material, each nominally 1/16 inch thick uncompressed, and having passages therethrough each of a diameter substantially equal to the diameter of the associated carburetor outlet and manifold inlet, and a second set of eight plates of a relatively imcompressible material, each nominally 1/16 inch thick, and having passages therethrough each of a diameter substantially ⅛ inch greater than the diameter of the associated carburetor outlet and manifold inlet, said plates of said first and second sets being interleaved in a stack to alternate said plates of said first and second sets and to coaxially align said passages therethrough, plates of said first set being positioned at the ends of said stack for sealed engagement with the carburetor base and the manifold when said spacer is positioned therebetween.

12. A device for mounting a carburetor to an intake manifold of an internal combustion engine, the carburetor being of a type having an outlet for communication with an inlet to the manifold to provide an air-fuel mixture thereto, said device comprising means for being positioned between the carburetor outlet and the manifold inlet for mounting the outlet substantially one inch from the inlet, said means having a passage for extending between the outlet and the inlet, said passage having a surface formed with spaced annular recesses along its length.

13. In a mounting as set forth in claim 12, said passage being of an inner diameter substantially equal to the diameter of the outlet, said recesses being equally spaced along the length of said passage and lying in planes perpendicular to the axis thereof.

14. In a mounting as set forth in claim 13, said recesses being of substantially square cross section.

15. In a mounting as set forth in claim 14, said recesses having a width and a depth of substantially 1/16 inch and being spaced apart substantially 1/16 inch along the length of said passage.

* * * * *